US005526765A

United States Patent [19]

Ahearn

[11] Patent Number: 5,526,765

[45] Date of Patent: Jun. 18, 1996

[54] THROUGH-HULL INSTRUMENT MOUNTING BRACKET

[76] Inventor: John M. Ahearn, 66 Tamarind Dr., Key West, Fla. 33040

[21] Appl. No.: 267,353

[22] Filed: Jun. 29, 1994

[51] Int. Cl.[6] ..... B63B 9/00

[52] U.S. Cl. ..... 114/343; 114/221 R

[58] Field of Search ..... 114/343, 221 R; 440/53, 61, 59, 60, 63, 54; 248/59, 284; 373/173, 141

[56] References Cited

U.S. PATENT DOCUMENTS

| | | | |
|---|---|---|---|
| 2,151,004 | 3/1939 | Barclay | 440/54 |
| 3,807,347 | 4/1974 | Baldwin | 440/54 |
| 3,880,106 | 4/1975 | Farmer | 440/113 |
| 4,075,971 | 2/1978 | Reginensi et al. | 440/54 |
| 4,888,747 | 12/1989 | Williams | 367/173 |
| 5,016,225 | 5/1991 | Blomberg | 367/173 |
| 5,186,428 | 2/1993 | Falkenberg | 248/284 |

FOREIGN PATENT DOCUMENTS

| | | | |
|---|---|---|---|
| 2652559 | 4/1991 | France | 440/54 |

*Primary Examiner*—Stephen Avila

[57] ABSTRACT

A mounting device for a marine transducer allows for adjustment of the angle of the transducer. This allows a directional transducer to look forwardly beneath the water surface for potential perilous passages or schools of fish, as well as to look downwardly for purposes such as depth determination. The mounting consists of a tubular housing which forms a watertight sea chest or wet box. The housing serves to store and protect the electronic transducer. A hinged end piece on the bottom of the housing serves to mount the transducer as well as provide the capability of angular inclination and, if desired, provide a drag-free flush mount. A powered reciprocating rod is provided to change the angle of the transducer. Indicators may be provided for displaying the inclination angle.

1 Claim, 3 Drawing Sheets

THROUGH-HULL INSTRUMENT MOUNTING BRACKET

CROSS REFERENCE TO RELATED DISCLOSURE DOCUMENT

This invention was disclosed in Information Disclosure Document No. 330,883, filed with the United States Patent and Trademark Office.

BACKGROUND OF THE INVENTION

FIELD OF THE INVENTION

The present invention relates to a mounting bracket for marine instruments.

More specifically, it relates to a pivotal, through-hull mounting for a transducer such as used with a marine sonar unit. The bracket allows the transducer to be aimed at different angles in a vertical plane during travel thus significantly increasing the effectiveness and utility of the transducer or other sensor unit.

The primary fields seen as benefiting from the advantages of this invention are the fishing and recreational boating industries. Many other possible uses will occur to those skilled in the arts involved. Thus it can be seen that the potential fields of use for this invention are myriad and the particular preferred embodiment described herein is in no way meant to limit the use of the invention to the particular field chosen for exposition of the details of the invention.

A comprehensive listing of all the possible fields to which this invention may be applied is limited only by the imagination and is therefore not provided. Some of the more obvious applications are mentioned herein in the interest of providing a full and complete disclosure of the unique properties of this previously unknown general purpose article of manufacture. It is to be understood from the outset that the scope of this invention is not limited to these fields or to the specific examples of potential uses presented hereinafter.

DESCRIPTION OF THE PRIOR ART

Marine instruments such as depth finders, speed sensors, sonar, and the like are mounted on boats, typically on the transom, so as to extend from the stern down into the water. Others are mounted forward of the boat's transom and project through the hull whereby the sensor portion of the unit extends into the water forward of the transom.

Special problems occur when an instrument must be mounted through the hull of a boat. First of all, the hull is exposed to a considerable pressure head while the boat is in operation but, of course, the primary function of keeping the water out of the boat must be accomplished. Therefore any through-hull sensor mounting must provide a strong watertight seal. Secondly, the external surface of the hull is often polished and scientifically designed so as to provide streamlined passage of the boat through the water. Any discontinuities in the hull surface, such as might be presented by a through-hull transducer mounting, can seriously impede the efficiency of propulsion of the boat.

For all these reasons, the prior art, although it has considered all these problems in bits and pieces, has never provided a through-hull transducer mounting bracket which is also capable of variable angulation as in my unique invention. As will be seen, the simplicity and effectiveness of the present invention is not rivaled in the prior art.

U.S. Pat. No. 3,531,988 to Casani et al. shows a through-hull knotmeter. A tiny electronic paddle wheel extends into the water through a cylindrical sealed tube in the hull. The orientation of the sensor is not adjustable during use. The sensor also projects a permanent drag producing discontinuity through the hull. By contrast, the device of the instant invention mounts a sensor so as to be angularly adjustable about a horizontal axis while, at the same time, having a position presenting no drag inducing discontinuity on the hull when in the stored position.

United States Pat. No. 5,186,050, issued to Lagace et al. shows a marine sensor mounting mechanism having a tubular sleeve in the hull of a boat. Valve means are mounted for pivotal movement in the sleeve from an open position when the sensor is in place to a closed position when the sensor is removed. The thrust of this patent is the provision of a valve means to allow the removing of the sensor from the boat without removing the boat from the water. The orientation of the sensor is not adjustable during use. The sensor also projects a permanent drag producing discontinuity through the hull. By contrast, the device of the instant invention mounts a sensor so as to be angularly adjustable about a horizontal axis while, at the same time, having a position presenting no drag inducing discontinuity on the hull when in the stored position.

United States Pat. No. 4,938,165, issued to Williams et al. shows a method for mounting a transducer in a boat hull. An end of the transducer is mounted flush with the boat hull thus obviating the induced drag problem. However, the transducer is permanently fixed in position with respect to the hull. By contrast, the device of the instant invention mounts a sensor so as to be angularly adjustable about a horizontal axis while, at the same time, having a position presenting no drag inducing discontinuity on the hull when in a stored position.

United States Pat. No. 4,534,307, issued to Overs shows an adaptor for installation of marine instruments. Essentially the adaptor consists of a tapered washer which eliminates the need for countersinking the bore through the boat hull. A gentle external taper is provided to enhance streamlining the introduced hull discontinuity. The mounted position of the sensor is not adjustable. By contrast, the device of the instant invention mounts a sensor so as to be angularly adjustable about a horizontal axis while, at the same time, having a position presenting no drag inducing discontinuity on the hull while in a stored position.

It will be noted that all the prior art through-hull devices are fixed with respect to the hull after mounting. In the case of a sonar transducer this fixation causes a serious restriction on the flexibility of use of the sonar. Also, most of the through-hull devices form permanent undesirable drag inducing discontinuities on the exterior surface of the hull. These can and do seriously impede the performance of the boats upon which they are mounted.

None of the above inventions and patents, taken either singly or in combination, is seen to describe the instant invention as claimed.

SUMMARY OF THE INVENTION

Briefly, the invention comprises a mounting means for a marine transducer which allows adjustment of the angle of the transducer. This allows a directional transducer to look forwardly for potential perilous passages or schools of fish, as well as to look downwardly for purposes such as depth determination. The mounting consists of a frame and mounting bracket that is mounted in a sea chest. The housing or sea chest serves to store and protect the electronic transducer as well as provide capability of adjusting the angle on a horizontal axis and, if desired, provide a drag-free flush mount for the transducer. Powered angle changing means are provided as well as indicators for displaying the inclination angle.

Accordingly, it is a principal object of the invention to provide a new and improved through-hull transducer mounting device which overcomes the disadvantages of the prior art in a simple but effective manner.

It is another object of the invention to provide such a through-hull transducer mounting device which contains no external protrusions likely to induce drag or catch on objects beneath the water line.

It is another object of the invention to provide such a through-hull transducer mounting device which is capable of fixing the inclination angle of the transducer by 180 degrees in either direction about a vertical axis and varying by 90 degrees about a horizontal axis; thus providing the capability of mounting the transducer in any direction beneath the surface of the water, such as straight ahead or straight to the stern where it then can be rotated 90 degrees about a horizontal axis.

It is another object of the invention to provide such a through-hull transducer mounting device in which the angle of the transducer is precisely varied by controlled power means.

It is a major object of this invention to provide a through-hull transducer mounting device which has a housing affixed to the hull and a hinged housing closure member which carries an electronic transducer.

Finally, it is a general goal of the invention to provide improved elements and arrangements thereof in an apparatus for the purposes described which is inexpensive, dependable and fully effective in accomplishing its intended purposes.

The present invention meets or exceeds all the above objects and goals. Upon further study of the specification and appended claims, further objects and advantages of this invention will become apparent to those skilled in the art.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
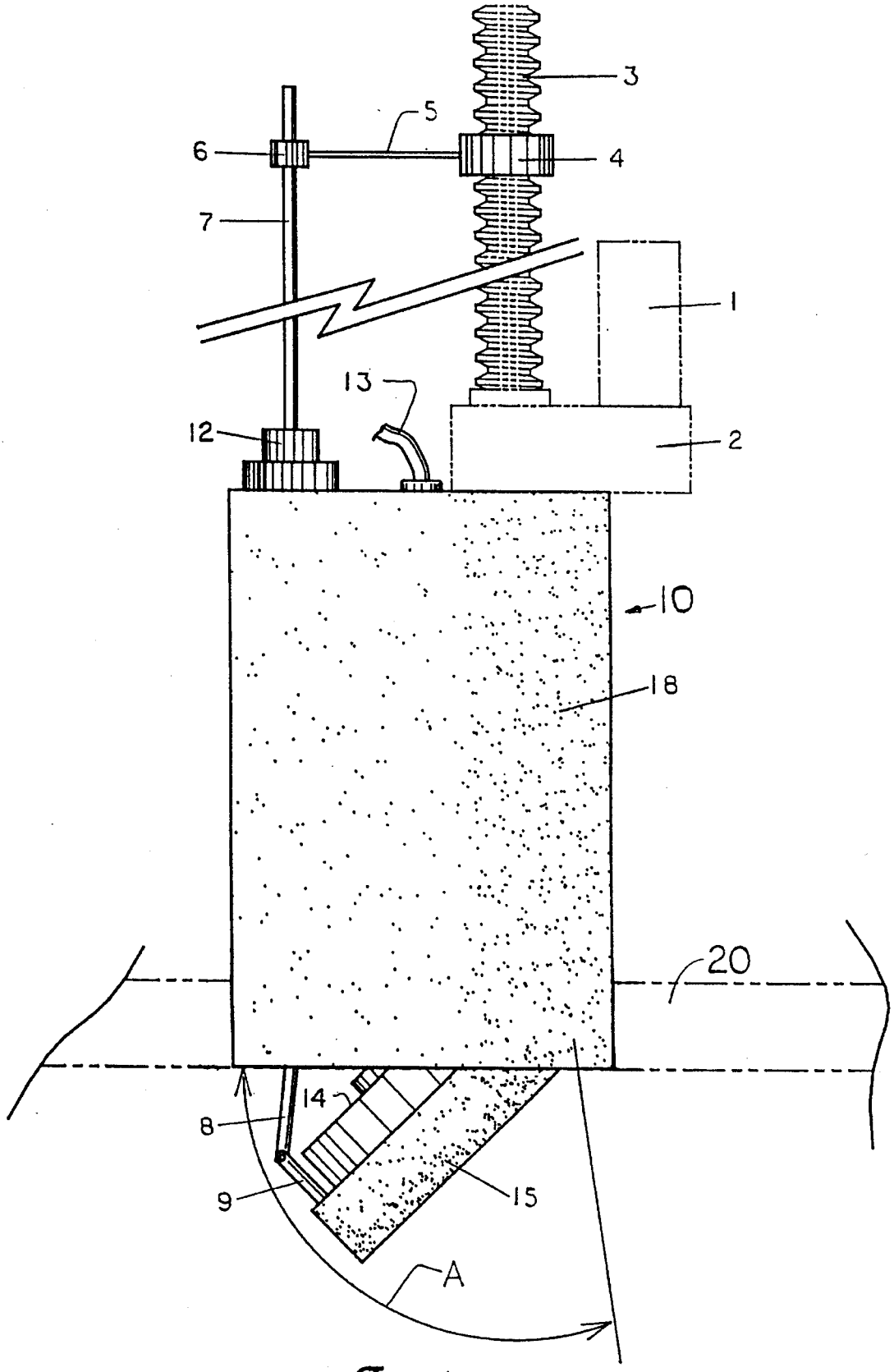
FIG. 1 is a side view of the invention shown flush mounted in a boat hull with the transducer hinge partially open.
Figure 2:
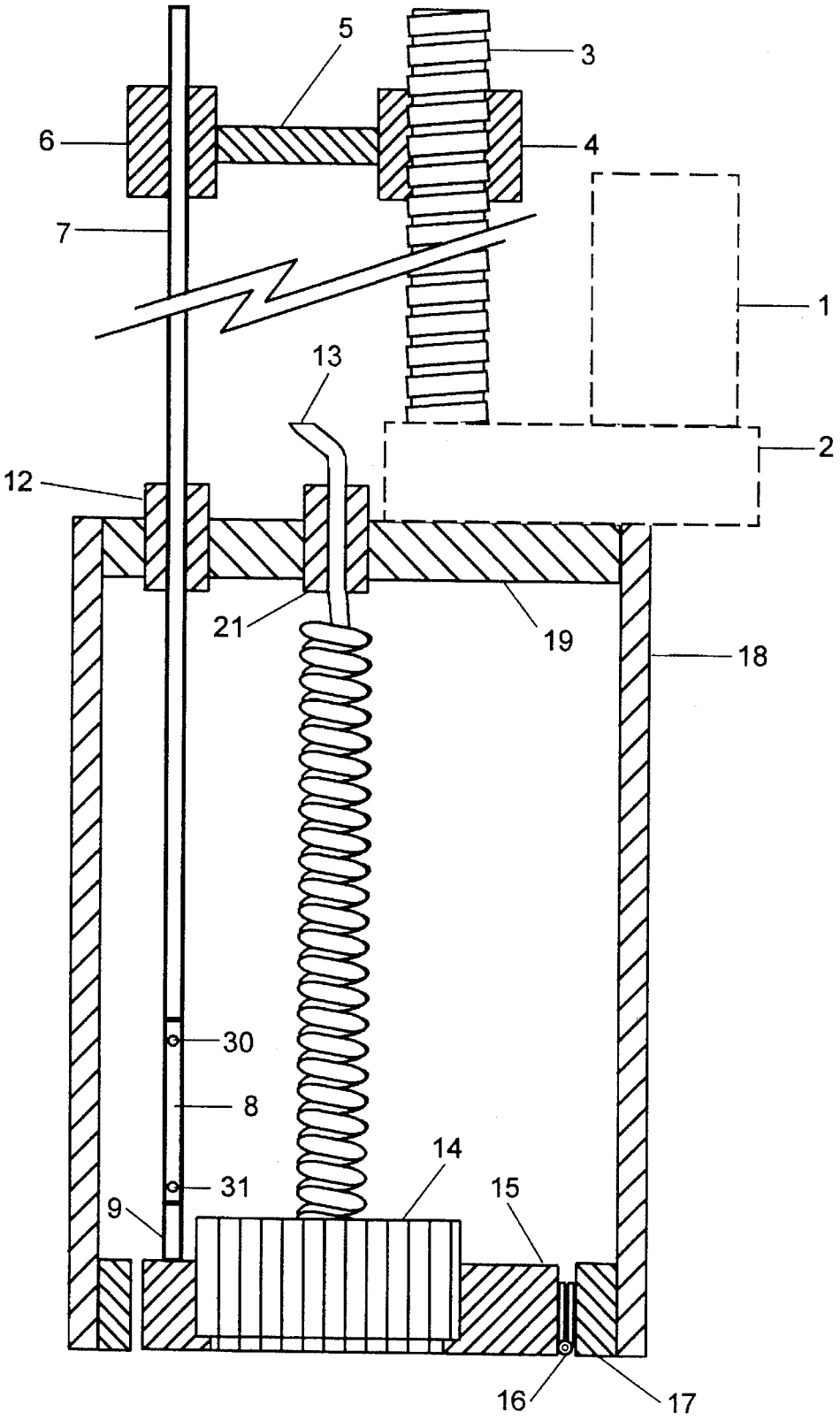
FIG. 2 is a cross-sectional view of the embodiment of FIG. 1 taken along a vertical plane through the center line of the housing.
Figure 3:
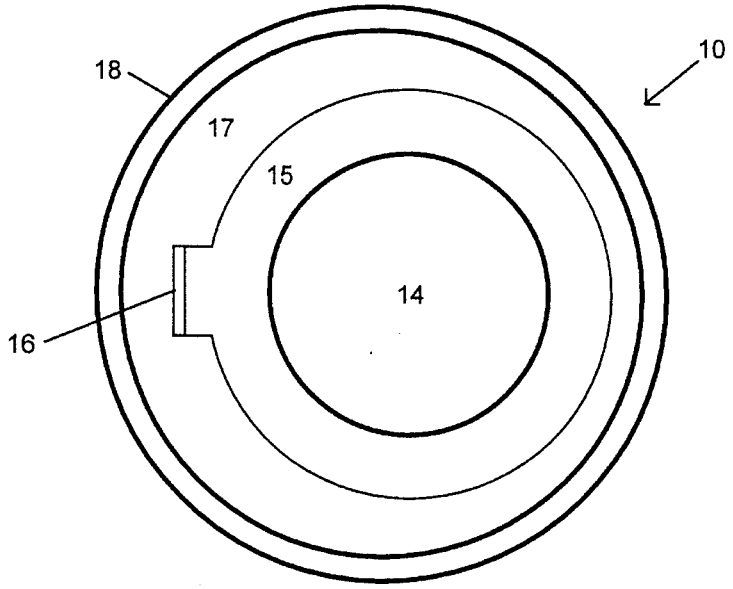
FIG. 3 is a bottom view of the invention showing the eccentric relationship of the hinge cover with respect to the housing.

The present invention is indicated generally at 10 in FIGS. 1 through 3 which represents a first preferred embodiment. Referring generally to FIGS. 1, 2, and 3, the improved transducer mounting bracket has a generally cylindrical housing wall 10 sealed at the top by circular plate 19 and at the bottom by circular plate 17 that is not sealed and allows for the passage of water in and out of the sea chest as the transducer is rotated in its housing and thereby allowing the water to be displayed as the transducer entering the sea chest. The cylindrical housing is mounted through a boat hull 20 by convention means.

Bottom plate 17 has an eccentric circular opening therethrough which is closed by hinged circular mounting plate 15. Flush mounted in plate 15 is an electronic marine transducer 14. As plate 15 is swung about hinge 16 through the extent of arrow A (FIG. 1) it will be seen that the angle of transducer 14 is varied by an angle of up to 90 degrees with respect to boat hull 20. This angular variation provides this ability to point the transducer in any direction on a vertical plane. This ability is a key feature of the present invention and allows for a flexibility of use hitherto impossible. Schools of fish or obstructions may be located ahead of the boat, is an aid to navigation, and the transducer may be pointed directly downward for obtaining accurate depth readings. It will be noted that, when the transducer is pointed downward, the hinged plate 15 is substantially flush with the bottom of boat hull 20. In this position there are no efficiency-robbing, drag-producing projections into the water as with many prior art arrangements.

Top plate 19 has two sealed openings. One opening is for the passage of a coiled conduit 13 leading to transducer 14 and it is sealed by means of a grommet 21. The other opening is for the passage of a reciprocating rod 7 for pivoting hinged plate 15. The means for reciprocating rod 7 will be more fully described later but the sealing means where it passes through top plate 19 is shown at 12. Sealing means 12 may be of any suitable type as, for example, O-ring seals within the collar 12. The artisan will recognize many other means of sealing a reciprocating rod with respect to a fixed plate with teachings from the hydraulic ram art being applicable.

The hinged plate 15 is pivoted to bottom plate 17 by means of hinge 16.

A powered hinge plate opening mechanism is located atop the device. Control means sends command signals to motor 1 and gear box 2 to rotate worm shaft 3 a predetermined amount in either direction. As shaft 3 rotates, ball nut 4 is caused to move upward or downward on the shaft. Nut 4 is connected to adjustment clamp 6 by bracket 5. Adjustment clamp 6 is adjustable fastened to reciprocating rod 7. Thus rotation of shaft 3 causes precision vertical movement of nut 4, bracket 5, clamp 6, and reciprocating rod 7. At the lower end of reciprocating rod 7 is articulated tie rod 8 by means of rod hinge 30. The other end of tie rod 8 is articulated to upstanding rod 9 by means of rod hinge 31. Upstanding rod 9 is rigidly affixed to hinged plate 15 on the side opposite the hinge 16. The main purpose of the articulated rod system is to allow for the angular deviation occurring during the pivoting of hinged plate 15 while at the same time preventing interference with transducer 14. A potentiometer is included in the drive magnetism to indicate the angle of the transducer in relationship to the hull.

Of course other conventional means, such as a hydraulic ram, could be used to obtain the reciprocation of rod 7. The main disadvantage of the hydraulic ram is that a source of pressurized hydraulic fluid may not be readily available on all craft.

Figure 4:
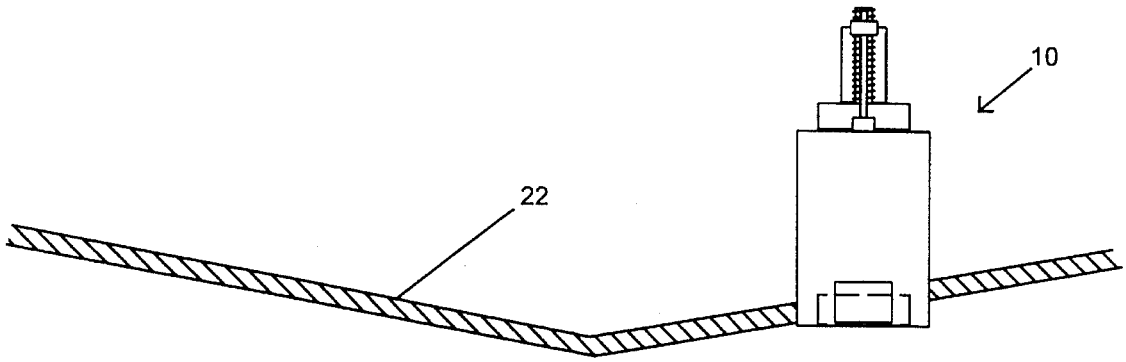
FIG. 4 is a front view partially in cross-section, showing a second embodiment of the invention mounted in the side of a boat hull.

A slight variation of the hull mounting of the device 10 is shown in FIG. 4. This arrangement will be useful if the sides of the hull are slanted and the draft of the boat is to be kept at a minimum. The cylindrical device is shown mounted vertically through the sloped side or dead rise of a hull 22. Of course this arrangement sacrifices the flush mounted configuration, but there may be times when minimum draft is more important or a flat bottom surface is not available in the hull.

LIST OF REFERENCE NUMERALS UTILIZED IN THE DRAWINGS

1 motor
2 gear box
3 ball screw shaft
4 ball nut
5 bracket
6 adjustable clamp
7 reciprocating rod
8 articulated rod
9 upstanding rod
10 transducer mounting device
12 reciprocating rod seal
13 coiled transducer conduit
14 transducer
15 hinged plate
16 hinge
17 bottom plate
18 cylindrical housing
19 top plate
20 boat hull
22 slanted boat hull
30 rod hinge
31lower rod hinge
A angular range arrow It is to be understood that the provided illustrative examples are by no means exhaustive of the many possible uses for the present invention.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

I claim:

1. A watercraft transducer mount by which the angle of a transducer can be changed from vertical to horizontal in relation to a hull of a watercraft comprising:

a housing means mounted in an opening in the hull;

a top plate sealed to said housing to prevent water from entering the hull via the opening;

a bottom plate on said housing means and having a bottom surface mounted flush with the bottom of the hull;

a hinged plate pivotally mounted to the bottom plate by hinge means, said hinged plate having a bottom surface which is flush with the hull bottom in a raised position;

a transducer mounted on the hinged plate, said transducer having a bottom surface mounted flush with the hinged plate bottom surface allowing downward viewing while flush with the hull bottom for drag free operation;

power means for pivoting said hinged plate and said transducer with respect to the housing and bottom plate; and, wherein when said power means is operated the angle of the transducer with respect to the hull is varied through at least 90 degrees to look forwardly for potential perilous passages or school of fish as well as to look downwardly for purposes of depth determination.

* * * * *